US007300179B1

(12) United States Patent
LaDuke et al.

(10) Patent No.: US 7,300,179 B1
(45) Date of Patent: Nov. 27, 2007

(54) LIGHT SHEET DISPLAY USING LIGHT STRIPS WITH ADJUSTABLE POSITIONS AND ORIENTATIONS

(75) Inventors: Thomas Frasier LaDuke, Orange, CA (US); Mark A. Reichow, Valencia, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 11/619,670

(22) Filed: Jan. 4, 2007

(51) Int. Cl.
*F21V 33/00* (2006.01)
*F21W 121/00* (2006.01)

(52) U.S. Cl. ..... 362/253; 362/96; 362/244; 362/220; 362/806; 40/428

(58) Field of Classification Search ..... 362/234–235, 362/238–240, 227, 806, 244, 217, 219–225, 362/96, 294, 253, 285, 287; 40/406, 409, 40/412, 428, 431, 436, 439; 392/348; 472/65
See application file for complete search history.

(56) References Cited

U.S. PATENT DOCUMENTS

| | | | | |
|---|---|---|---|---|
| 4,026,544 | A | 5/1977 | Plambeck et al. | |
| 6,461,011 | B1 * | 10/2002 | Harrison | 362/96 |
| 6,554,443 | B2 * | 4/2003 | Fan | 362/96 |
| 6,757,487 | B2 | 6/2004 | Martin et al. | |
| 6,827,458 | B2 | 12/2004 | Suga | |
| 6,952,310 | B1 | 10/2005 | Miyatake et al. | |
| 6,953,401 | B2 | 10/2005 | Starr | |
| 6,955,440 | B2 | 10/2005 | Niskanen | |
| 7,001,058 | B2 | 2/2006 | Inditsky | |
| 7,004,610 | B2 | 2/2006 | Yamashita et al. | |
| 7,016,116 | B2 | 3/2006 | Dolgoff | |
| 7,018,060 | B2 | 3/2006 | Choi et al. | |
| 7,080,472 | B2 | 7/2006 | Schroeter et al. | |
| 7,093,949 | B2 | 8/2006 | Hart et al. | |
| 7,111,421 | B2 | 9/2006 | Corry et al. | |
| 2002/0080601 | A1 * | 6/2002 | Meltzer | 362/96 |
| 2003/0053305 | A1 * | 3/2003 | Lin | 362/96 |
| 2006/0034100 | A1 | 2/2006 | Schnuckle et al. | |
| 2006/0098428 | A1 * | 5/2006 | Rosserot | 362/227 |
| 2006/0101681 | A1 | 5/2006 | Hess et al. | |
| 2006/0227548 | A1 * | 10/2006 | Huang et al. | 362/244 |
| 2006/0262545 | A1 | 11/2006 | Piepgras et al. | |

OTHER PUBLICATIONS

Vaughn Safety, Inc., product catalogue, littlebrightlights.com, Oct. 20, 2006.

* cited by examiner

*Primary Examiner*—Laura Tso
(74) *Attorney, Agent, or Firm*—Marsh Fischmann & Breyfogle LLP; Kent A. Lembke

(57) ABSTRACT

An apparatus for generating light sheets useful in flame simulators or other lighting displays. The apparatus includes first and second light strips, which may include light emitting diodes of differing colors. Each of the light strips is mounted on support members that are mounted in the apparatus to rotate such that the orientations of the light strip outputs can be adjusted. The support members are mounted on end plates that can be rotated such that the light strips can be moved to be into a single plane or into differing planes, and the support members may be rotated to set the orientation of the light strips. Positioned over each light strip is an elongate projection lens such as a cylindrical rod. The light generated by the light strips is focused by the projection lenses into a sheet of light by converging and combining the light from the light strips.

20 Claims, 6 Drawing Sheets

LIGHT SHEET DISPLAY USING LIGHT STRIPS WITH ADJUSTABLE POSITIONS AND ORIENTATIONS

BACKGROUND OF THE INVENTION

1. Field of the Invention

The present invention relates, in general, to special effect lighting devices and systems such as those used to imitate or simulate flames from an actual fire, and, more particularly, to an assembly for generating thin sheets or planar displays of light that can be used to simulate flames when projected onto fabric flame elements that move or flow downstream of a fan, e.g., a special effect system for displaying fire or other lighting effects in a window and/or over large surfaces.

2. Relevant Background

There are many applications and uses for devices that simulate fire or the flames of a fire. For example, simulated flame devices or flame simulators are used in amusement parks to provide desired lighting and to create the illusion to people on a ride that they are passing fire. Simulated flames and fire is used in place of real fire to address safety and maintenance concerns. For example, the flame simulators may be provided as burning logs, torches held by ride characters or mounted on walls, and in situations calling for a large flame effect such as a burning window or building. Additionally, there is a growing trend toward the use of flame simulators in residential setting such as outdoor theme lighting, imitation logs burning in a fireplace, and the like.

A number of challenges face the designer of a flame simulator. There is a demand that the flame be realistic even from relatively short distances. Homeowners, amusement park operators, and other users also require that the flame simulators be very safe to use, be easy to maintain, and be relatively inexpensive. Existing flame simulators have not been able to effectively address all of these requirements, and there is a continuing demand for improved ways of producing a flame special effect.

One type of flame simulator uses a fabric flame element such as a silk flame element that is illuminated by a light source. To make the effect more realistic, air current or flow from a fan is directed over the flame element that can make produced "flame" appear to flicker. Unfortunately, there are a number of problems with using silk flame simulators especially in applications that require many hours of service such as in amusement parks and in outdoor residential and commercial lighting fixtures. Typical silk flame simulators use incandescent lighting to illuminate the flame elements. The bulbs have fairly short lives and need to be replaced regularly. In addition to replacement and maintenance issues, incandescent bulbs or lamps use significant amounts of energy and produce significant amounts of waste heat. Hence, the heat must be removed and/or the simulator has to be positioned in locations where it will not be contacted by people and flammable materials.

Standard silk flame elements are often not useful in larger displays such as those used for simulating flames in windows of a burning building (e.g., burning windows). Larger flame simulators generate significant amounts of heat that must be removed with air handlers and conditioning units that may be bulky and that are often expensive to operate and maintain. Some large flame simulation devices use incandescent or similar light sources that are masked or filtered to generate a thin sheet or plane of light that is projected onto fabric curtains or elements that are placed downstream of a fan or blower. In addition to generating unwanted heat, these devices often consume significant amounts of energy, such as thousands of Watts of energy for larger displays or systems. Many displays are operated many hours a day such as while an amusement park is open to the public. As a result, energy costs associated with existing large flame simulation devices can be quite high. Fiber optic systems have been created for producing light in a thin sheet, but these systems typically are very expensive and are often large and cumbersome making them inappropriate for applications requiring numerous simulators or having size restrictions.

Yet another problem with many flame simulators, including silk flame simulators, is the amount of extra unwanted light that passes by the flame (i.e., blow-by). Blow-by is a particular problem in dark, enclosed areas such as ride tunnels or chambers and can essentially destroy the overall look of the flame illusion that is produced by the flame simulator.

There continues to be a demand for innovative flame simulators. Preferably, such flame simulators will be easy to maintain, will produce less heat, will be inexpensive to manufacture, and will produce improved visual effects (i.e., more accurately represent flames of a fire to an observer).

SUMMARY OF THE INVENTION

The present invention addresses the above problems by providing display assemblies that are useful for generating light sheets or thin curtains of light that can in turn be used in flame simulators and other light display systems and devices with improved longevity, reduced maintenance requirements, safer operations, and significantly improved visual effects (e.g., improved large flame effects). Generally, the display assemblies use two or more light strips, such as a linear arrangement of light emitting diodes (LEDs), to provide dispersed beams of colored light (or white light). A lens is mounted adjacent each of these light strips to focus, bend, or converge the output light beams into two or more thin sheets or less dispersed curtains of light that can be displayed separately or, more commonly, mixed as they are directed onto a display screen or element (such as a fabric element supported in a window frame or other support structure). In one exemplary but not limiting embodiment, a set of amber LEDs and a set of red or red-orange LEDs are used as the light strips and have a 50 to 100 degree beam dispersion. A rod (such as an acrylic or a plastic, glass, or ceramic rod) is used as the lens (sometimes generally referred to as a projection lens) to create the sheet of light from each set of LEDs or light strip. The lens and light strip are mounted on supports (such as channels) that are mounted on end plates so as to be swiveled about their axes to allow adjustment of the light strip orientation (e.g., to direct the output light sheet as desired). Further, the end plates may be mounted to rotate about a central axis of the plates such that the supports and the attached light strips may be selectively positioned (i.e., in a single horizontal plane or in differing horizontal planes).

More particularly, an apparatus is provided for generating a sheet of light that can used, for example, in flame simulators or other lighting or lighted displays. The apparatus includes first and second light strips, which may be formed, for example, of sets of light emitting diodes (LEDs) of the same or differing colors. Each of the light strips are mounted on support members, and in some embodiments, the support members are spaced apart but positioned generally parallel to each other. The support members may be mounted to allow them to be rotated about their mounting points (e.g., about an axis extending parallel to the support members)

such that the orientations of the light strip outputs can be adjusted. Further, the support members (and the mounted light strips) are generally mounted such that the light strips are in the same horizontal plane and such that, at least in some embodiments, the light strips can be moved (i.e., have their position adjusted) to be in differing horizontal planes. Positioned over or adjacent each light strip is an elongate lens that runs substantially parallel to the light strip, and may be mounted onto the support member to be abutting or spaced apart from the light strip.

During operation, the light generated by the first and second light strips is focused or bent by the lenses into a sheet of light formed by combining or mixing the light from the two light strips. For example, the light strips may be formed of a series of LEDs with a fairly dispersed beam spread, e.g., 20 to 100 degree outlet angle or the like, and the lens may be configured to generate a less divergent, planar, or converging beam to provide a sheet or curtain of light (e.g., a sheet with a spread of less than about 20 degrees such as between about 10 and 15 degrees). In some embodiments, the lens is a cylindrical rod formed of plastic, glass, or ceramic that is at least translucent to the light from the LEDs. In one embodiment, the lens is a rod formed of an acrylic or other material useful for lenses with a diameter of about 0.5 inches or larger in many embodiments. In other embodiments, the lens is a lens with a thinner cross sectional shape such as a thin Fresnel or other lens. For example, the lens may be one or more thin Fresnel lenses that is manufactured to provide a particular focal length in a cylindrical or other shaped cross section, which provides a lower profile and simpler packaging (e.g., on or nearer to the light strips or within single housing holding the light strip and the lens). To obtain a desired mixing of the two sheets of light into a combined sheet or curtain of light, the support members may be adjusted to be in the same or differing horizontal planes and the orientation of one or both of the support members and attached light strip may also be adjusted (e.g., by rotating the support member on its axis).

According to another aspect of the invention, a flame simulator is provided that includes a fan blowing or moving a volume of air and a display element or screen positioned downstream of the fan in the moving air. A light sheet display assembly is also provided that includes a linear strip of light emitting diodes that each generate a beam of light. The assembly farther includes a lens that converges the beams of light from the diodes into a sheet of light (e.g., a substantially planar or thin beam of light relative to the dispersed beams from the diodes such as with a beam spread of less than about 20 degrees) that is projected or directed onto the display screen. The lens may be formed from one or more elongate cylindrical lenses that are spaced apart from the linear strip and that extend substantially parallel to the linear strip and its LEDs. A second or additional linear strip of LEDs may be provided that have a different color (e.g., the first set of LEDs may be amber and the second red or red-orange or another color). Also, a second or additional lens is provided to converge or bend the beams from these additional LEDs into a sheet of light that is also directed toward or onto the display screen with or without mixing with the first sheet of light. The linear strips are typically mounted on spaced apart supports (e.g., extruded metal or plastic channels or the like) that are in turn mounted at their ends to a pair of mounting plates. The mounting plates preferably can be rotated to set or adjust the position of the two supports and their attached linear light strips, and the supports preferably are mounted on the plates to be able to rotate themselves to allow the orientation of each light strip to be set or adjusted to achieve a desired lighting effect. A controller may be provided for selectively operating (such as based on a software program or in response to sensed environmental conditions) the linear strips such as to vary the brightness levels such as to wash an output beam up and down or to strobe the output beam.

DETAILED DESCRIPTION OF THE PREFERRED EMBODIMENTS

Figure 1:
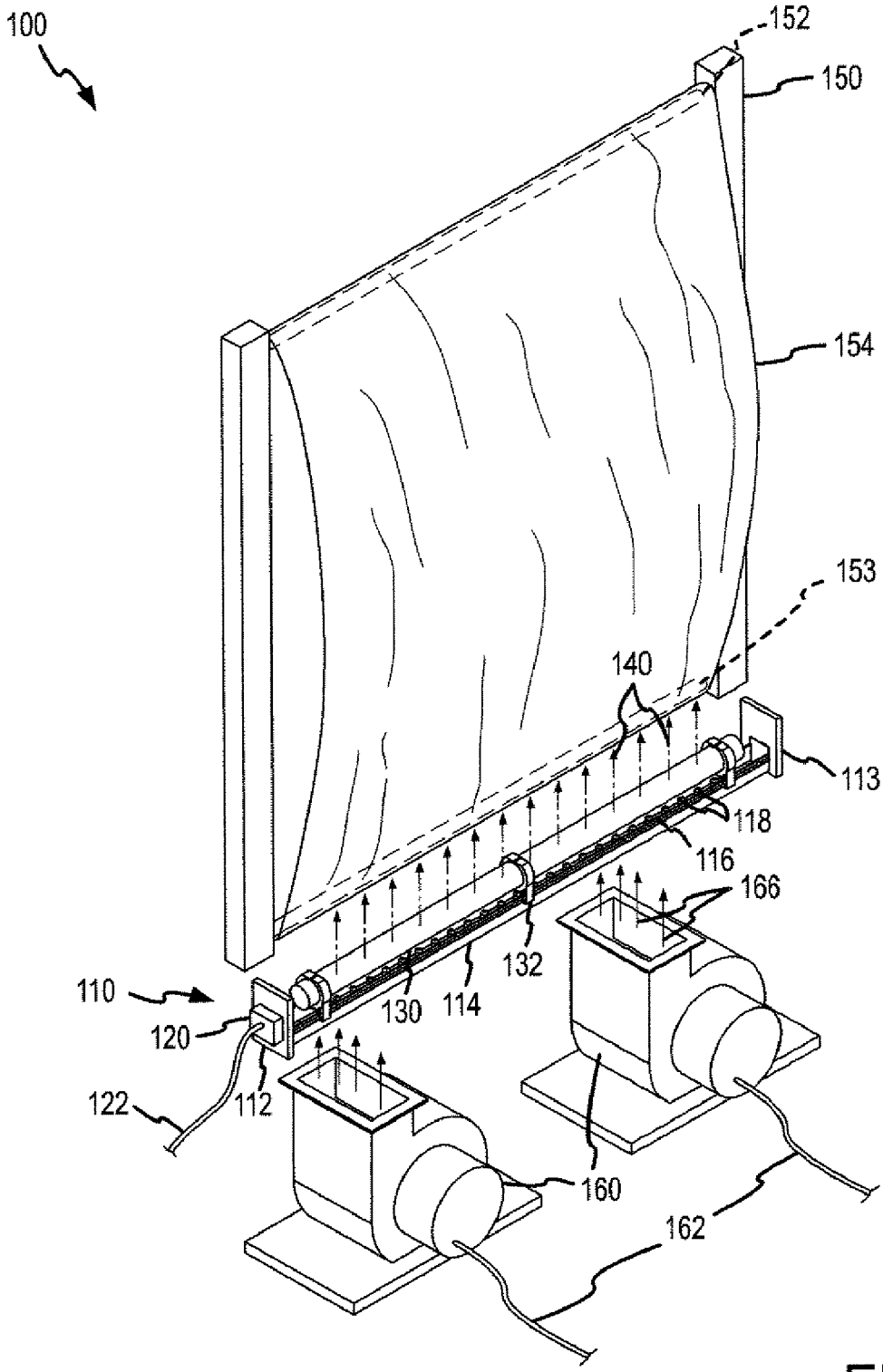
FIG. 1 is a perspective view of a flame simulator using a light sheet assembly of the present invention to project a thin sheet of light or planar light beam upon a display screen or curtain.

Briefly, the present invention is directed to light displays that provide a thin sheet or more planar beam of light and to lighting assemblies such as flame simulators that use such light displays to produce a desired effect, e.g., a window of a burning building. The light displays generally include one or more light sources configured to produce a light sheet and, for example, each light source may include a light strip such as a strip of light emitting diodes (LEDS) with a lens positioned at the output of the light strip. The lens may be thought of as a convergent lens in that it takes the relatively dispersed or spread beam from the light strip and converges or bends it into a thin sheet of light (e.g., up to about a 30 degree angular spread of the lens output beam). In some cases, the lens is a cylindrical lens formed from a rod of glass, plastic, or ceramic (e.g., an acrylic rod or the like) but other cross sectional shapes may be used to produce a beam that is more generally planar than the output of the light strip. The light sources are mounted upon supports that allow the sources to have their relative position adjusted as well as their orientation so as to achieve a desired output effect when their output beams are combined. For example, the light sources may be positioned in the same horizontal plane or in differing horizontal plane, and their orientation or output direction may be adjusted such as by rotating them about their axis to achieve a desired targeting or mixing of their output beams or sheets. When used in a flame simulator, the outputs of the light sources may be directed onto a display screen (such as a fabric screen supported within a window frame, over logs, or the like) with flickering or waving of the display screen produced by a wind source (such as one or more fans or blowers) targeting the display screen.

To provide a better understanding of the light sheet display assemblies of the present invention, it may be useful to first describe some of the engineering and design problems that were addressed in creating the assemblies to produce larger flame looks or effects such as windows in a burning building or "burning windows." It was determined that larger flame effects could be achieved by closing a door or metal adjustable masking on the outside of an incandescent light fixture or source down to a thin slit or elongate opening because this created an output beam that was a sheet or curtain of light. The sheet of light was then pointed up toward the base of a display screen or fabric supported by a frame (e.g., a window frame or the like) with the fabric, in turn, being blown, animated, or moved by one or more fans. The result was an improved large flame illusion as the display screen or fabric had enhanced contrasts between the "hot" and "cold" portions of the flame as the display screen or fabric was illuminated with brighter or hotter areas and deeper, darker cold areas. The use of light sources using incandescent lights, halogen lights, fiber optics, and other light sources were examined, and while achieving a desirable thin sheet or curtain of light effectively and being useful in some applications, these configurations were found to be have maintenance issues as the life of the bulbs or light sources was limited, to create significant amounts of heat, and to consume large amounts of energy. As a result, the inventors wanted to improved on this basic form of their invention (e.g., an light source combined with a mechanism for creating an thin sheet or curtain of light) to form other light sheet display assemblies that provide high quality large flame or other effects by providing a thin sheet of light with or without color while reducing heat production and power consumption and while controlling costs.

Briefly, a new light source or engine for a sheet of light was developed that used a light strip combined with a lens, which is sometimes referred to herein as a projection lens. In one embodiment, the light source or engine included a plurality of LEDs mounted on a board such as a printed circuit board (PCB) or the like and placing an elongate cylindrical lens on top of the LED strip. For example, the LEDs may have a wide beam spread such as up to 100 degrees or more and a rod formed of a material useful for a lens (e.g., glass, ceramic, or plastic such as an acrylic or the like) may be placed over the LEDs to receive the output from the LED strip and generate a more planar or thinner output beam. For example, it was found that a 0.75-inch acrylic rod was useful for converging or bending a beam of about 100 degree spread into a 10 to 15 degree thin sheet of light (i.e., the more dispersed light from the LED strip was "converged" into a thin sheet of light by an elongate lens). This light source was more energy efficient, produced relatively little heat, and was inexpensive to fabricate.

Some embodiments such as that shown in FIG. 1 utilize a single light strip or elongate light source that is fixed in position to provide a light sheet display when combined with an elongate lens. However, it has been determined by the inventors that improved special effects such as flame simulations can be achieved by combining two or more substantially planar output beams together and, particularly, when these output beams have colors that when combine simulate flames (such as amber and red or the like). Further, it was determined that it the illusion could be enhanced by allowing the light sources to be positioned relative to each other during installation to adjust the created effect to provide a better quality effect.

To this end, one embodiment of the light display assembly was created that uses two strips of LEDs as the light sources with one being red and one amber. These LED strips were fastened into a channel (e.g., a metal such as aluminum channel that was ⅝-inch wide by ⅜-inch deep by 33.5-inches long) such as with tape (e.g., a polyethylene, non-conductive, double-stick tape) or fasteners. A 0.75-inch diameter (e.g., acrylic glass or Plexiglas or other material suited for lenses) rod was selected as the lens and was fastened to the channel using fasteners (e.g., plastic clip type fasteners) to hold the rod at a desired distance to optimize or achieve a desired thin sheet output (such as holding the rod parallel to the LED strip at about 0.1 to 2 inches or more away from the LEDs). In other embodiments (not shown), the lens is formed from thin Fresnel or other lens configurations that may be selected to provide a desired focal length (e.g., onto an adjacent display screen or fabric sheet or the like), and these thin Fresnel and other lenses provide a lower profile and may provide simplified packaging. For example, the lenses may be cylindrical lenses such as a single lens or a series of cylindrical lenses (e.g., 0.5 to 3.25 or greater diameter cylindrical Fresnel lenses formed of plastic, glass, or other optical materials) such as those available from Edmund Optics Inc., Barrington, N.J.; Fresnel Technologies, Inc., Fort Worth, Tex.; or other distributors.

To allow the two sheets of light from the lenses to be blendable in numerous ways and to be positioned in differing horizontal planes, the channels holding the LED strips were mounted with their ends attached to two plates (e.g., 4-inch diameter metal such as aluminum disks) on opposite sides of the central axis of the plates. The plates were mounted with hardware (e.g., standoffs, angle brackets, bolts, washers, and the like) to be rotated about their central axis so as to position the light sources relative to each other either in the same horizontal plane or in differing horizontal planes. To allow the orientation of the light sources to be adjusted, the ends of the channels were mounted to the plates so as to allow them to swivel or rotate 360 degrees (or at least through a range of output angles such as up to 180 degrees or more). The thin sheets of light obtained by the combined outputs of the two light sources had superior quality when compared with other light sources (e.g., greater contrast between light and dark areas on an animated or waving fabric screen), had significantly reduced power consumption (e.g., from about 5300 Watts to about 316 Watts), had reduced or even negligible heat production, and had improved maintenance requirements (e.g., the LED engines or light sources are expected to last about 100,000 hours or about 17 years when used in an assembly that is operated 16 hours a day throughout the year).

Referring now to FIG. 1, a flame simulator 100 is illustrated that includes a light sheet display assembly 110 of the present invention to produce the illusion of flames burning in a building window. The assembly 110 includes two end mounting plates 112, 113 upon which a support member 114, such as a channel, strut, beam, or the like, is attached to extend between the inner surfaces of the plates 112, 113. In this embodiment, the support member 114 is rigidly mounted to the plates 112, 113 but in other embodiments, the member 114 may be mounted for rotating about its axis or mounting point. A board such as a PCB 116 is provided on or within the supporting member 114, and an elongate light or light strip 118 is provided that is shown in this embodiment to be formed from a plurality of LEDs. The strip 118 maybe powered using direct current (DC) and a power supply 120 for converting alternating current (AC) from a power source via line 122 to DC for use by the strip 118. Additionally, the supply 120 may be adapted for controlling the power supplied to the strip 118 to adjust the brightness of the light produced by the strip 118 (e.g., by the included LEDs).

As shown, the strip 118 is an elongate series of LEDs that are pointed upward away from the mounting board 116. A lens or projection lens 130 is positioned next to or above the light strip 118 with mounting clips or brackets 132, which support the lens 130 on the support member 114 at a distance from the strip 118 or its LEDs. The lens 130 is generally an elongate lens that may be a unitary piece of material such as a clear or substantially transparent glass, plastic, or ceramic or be formed of two or more pieces of such lens material. Generally, it is desirable for the lens 130 to converge the output of the light strip 118 into a more planar output beam or into a light sheet (e.g., from up to a 100 degree or greater beam spread to a spread of less than about 30 degrees and more typically less than about 15 degrees).

The light sheet 140 transmitted by the lens 130 is projected upward or toward a display screen 154 that is supported within a frame or support 150 such as on upper and lower rods 152, 153 or the like. The rods 152, 153 are typically chosen to be small and/or narrow enough to not significantly disrupt air flow 166, and the sheet or screen 154 is typically arranged to be able to billow, flow, and/or move in the air flow 166 to obtain a desired look. The lens 130 may be a cylindrical rod as shown (e.g., a 0.25 to 2-inch or larger diameter rod) or take on other forms to provide a desired planar light sheet 140 (e.g., a convergent lens formed of half of a cylinder or the like). In one embodiment, the display screen 154 is a sheet of fabric (e.g., white silk or the like) selected for its ability to flow or move in particular patterns when exposed to wind 166. The fabric selection for the screen 154 may be silk or any of a number of other fabrics that are commonly used to achieve theatrical and other special effects with light, and the fabric may be selected based on the fabric's weight and color and to obtain other qualities such as fray resistance and fire retardant. The wind 166 in the flame simulator 100 is provided by one or more blowers or fans 160 powered via cables/lines 162 and a power source (e.g., 120 VAC source not shown).

Figure 2:
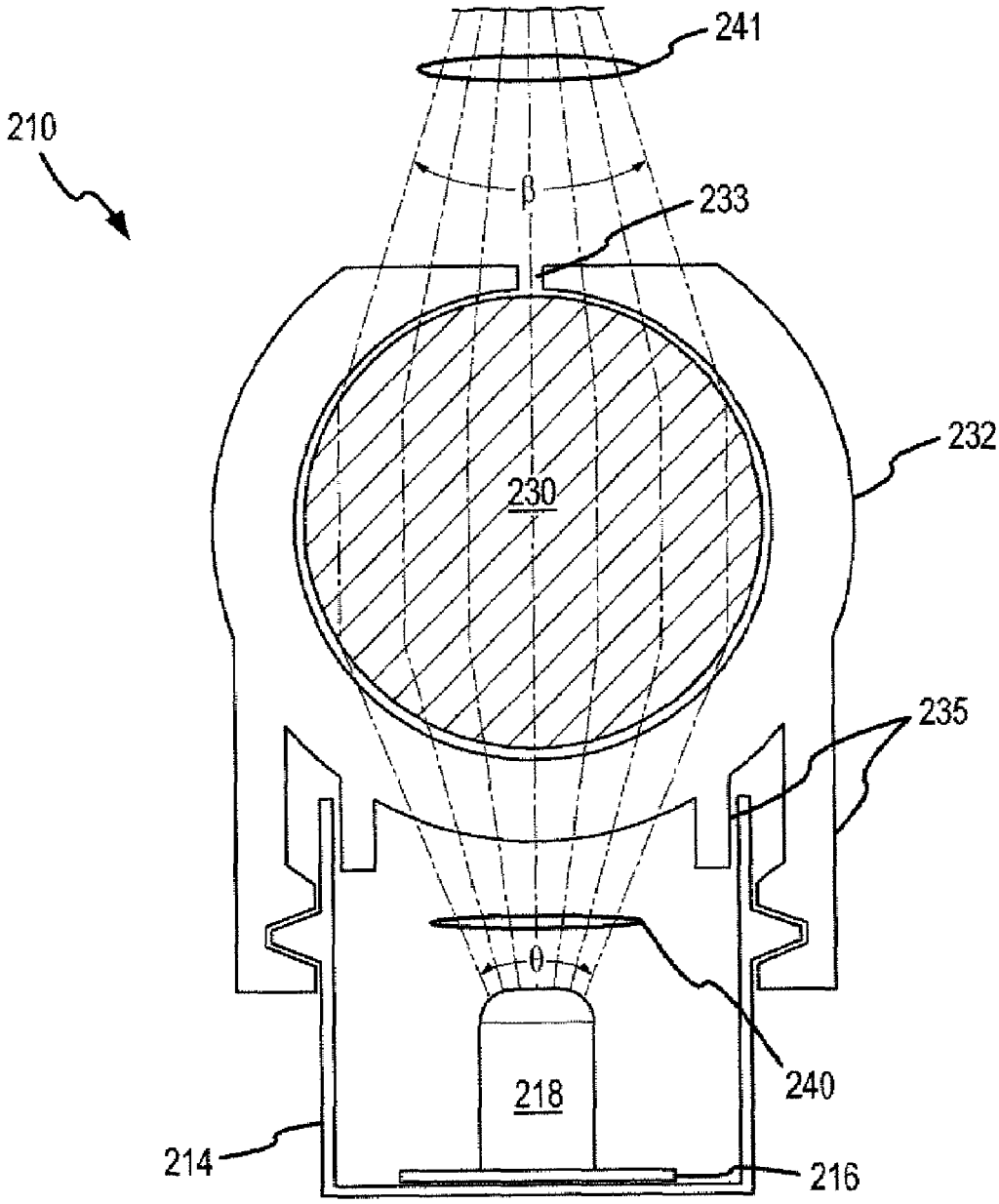
FIG. 2 is a sectional view of a light source of the present invention that may be used in light sheet assemblies such as that in FIG. 1 to provide a thin sheet of light.

FIG. 2 illustrates a sectional view of a light source 210 that may be used in light sheet display assemblies of the present invention. As shown, the light source 210 includes a support 214 (e.g., a metal or plastic channel) upon which a mounting board 216 is affixed such as using mechanical fasteners, tape, glue, or the like. The board 216 may be a PCB. The light source 210 includes a plurality of LEDs 218 mounted onto the board 216 for concurrent operation. For example, the board 216 and LEDs 218 may be provided as an LED strip (e.g., white, amber, red, or other colored LEDs which may operate on direct current such as 12 VDC) that includes 2 or more LEDs such as 5 to 10 LEDs or more with one embodiment using two light sources 210 with one having up to 60 or more amber LEDs (e.g., 62 LEDs in one case) and the other having up to 60 or more red LEDs (e.g., less than about 10 LEDs when one light source is shorter than the other). The LEDs 218 may include two or more high powered (i.e., up to about 3 or more Watts) light emitting diodes (LEDs) that are tuned (such as by operation of a power supply not shown in FIG. 2) to provide a desired brightness (e.g., 20 to 70 or more lumens). When two light sources 210 are used, the LEDs in the differing sources 210 are typically differing colors and the tuning is effective for achieving a desired color when the colored light from the two or more LED strips 218 are mixed. The use of LEDs are desirable for achieving increased hours of service and for controlling unwanted blow-by that may result from using too bright incandescent bulbs. Blow-by is further controlled and the fire effect enhanced by directing the LED-produced light sheet by mounting the LEDs to be directed to meet or cross where a display screen or fabric element (e.g., flame elements or their bodies and/or tips) will be located during operation of a simulator or display system and by the use of lenses 230 that better cause the produced light to be concentrated in a desired plane or sheet with a desired thickness or spread as measured from the surface of the lens 230 distal to the LEDs 218 (or angular beam spread of less than about 30 degrees such as between about 10 and 15 degrees or less).

As shown, the lens 230 is a cylindrical rod (e.g., a ¾-inch or larger or smaller translucent to clear rod) that is positioned over or adjacent the LEDs 218 with mounting clips 232 that have a split end 233 to account for varving sizes of lens 230 and manufacturing tolerances. Legs 235 of the clip 232 are configured for mating with the side walls of the channel or support 214 (e.g., the legs 235 may have a negative profile of ribbed edges on the channel side walls to lock them in place and hold the lens 230 static). The lens 230 may abut the top of the LEDs 218 but more typically is spaced apart a particular distance to better achieve a desired focusing effect with the lens 230 (e.g., by spacing the lens 230 up to 1 inch or more away from the LEDs 218). The LEDs 218 may generate an output light or beam 240 (i.e., the combined light output from the LEDs 218 in a light strip) with a relatively wide beam spread or output angle, θ, of 20 degrees or more (such as for brighter LEDs) with many LEDs 218 having view or output angles, θ, of up to 50 or even 100 degrees or more (such as for softer light 240 used for accenting or the like).

The lens 230 generally extends the length of the board 216 or along the length of the light strip formed of the LEDs 218 and is selected to have a cross section and size to focus or converge the LED output 240 and generate or transmit a light sheet 241. The light sheet 241 may be thought of as being generally planar or more planar than the LED output 240, and the lens 230 may have a beam spread that is significantly less than the LEDs 218 such as a spread, β, of less than about 30 degrees, more typically less than about 20 degrees, and even more typically less than about 15 degrees (e.g., 10 to 15 degree thin sheet 241). The specific focusing or converging effect achieved by the projection lens 230 is not limiting to the breadth of the invention as long as the output 240 of the LEDs 218 is combined into an output 241 that is more planar or thinner than the thickness of the output 240 (e.g., the output 241 may actually be diverging from the lens 230, may provide substantially parallel rays that are thinner than provided by LEDs 218, or be converging to a line at some distance from the lens 230). The LEDs 218 may be mounted in differing manners than shown in FIG. 2 to practice the invention, e.g., a prefabricated LED strip may be mounted in the support 214 (e.g., LED strips in acrylic channels or the like available from numerous distributors), and it is not necessary that the LEDs 218 be uncovered (i.e., material may be positioned between the LEDs 218 and the lens 230).

Figure 3:
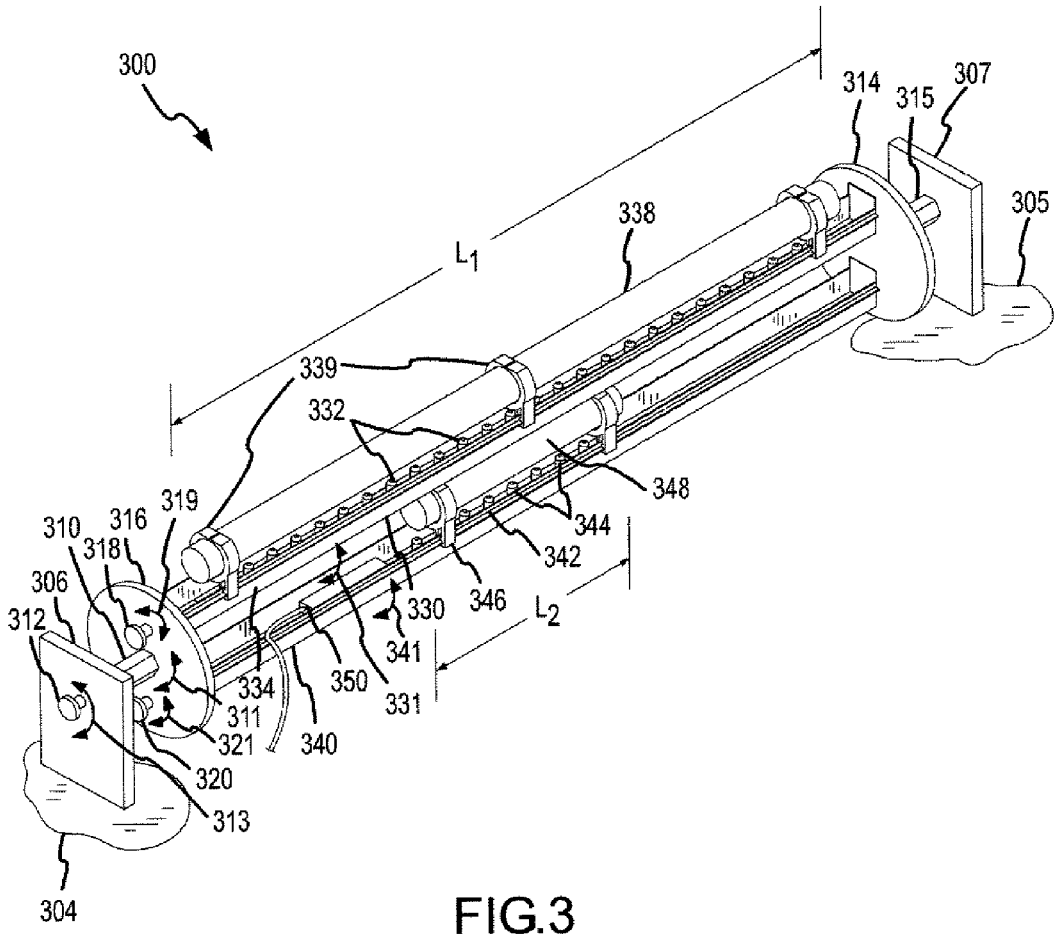
FIG. 3 is a perspective view of another embodiment of a light sheet assembly of the present invention using two light sources with adjustable relative position and adjustable orientation to achieve a sheet of light or planar light beam by blending the output of the two light sources (which are differing in length in the illustrated embodiment but may be equal in length in other embodiments)

FIG. 3 illustrates a light sheet display assembly 300 that provides two light sources with adjustable position and orientation. To this end, the assembly 300 includes a base mounting structure 304, 305 such as two or more struts upon which two mounting elements 306, 307 are rigidly mounted. End plates 314 and 316 are connected to these static mounting elements 306, 307 via connecting rods or shafts 310, 315. The rods 310, 315 are rigidly attached to the plates 314, 316 but are free to spin on their mounting to mounting elements 306, 307, and hence, the plates 314, 316 rotate 311 when a position adjustment knob 312 connected to the end of the rod or shaft 310 is rotated as shown at 313. Such rotation 313 is useful for adjusting the position of the light sources into a single plane as shown in FIG. 4 or into differing horizontal planes as shown in FIG. 3.

A first light source is provided by mounting an elongate support or channel 330 between the two plates 314, 316 spaced apart from the central axis of the plates 314, 316 (or rods 310, 315). A series of LEDs 332 are provided on a mounting/power board 334 (e.g., a PCB). The first light source is completed by mounting a projection lens 338 (e.g., a cylindrical rod or the like formed of glass, plastic, or ceramic that is transmissive to light from the LEDs 332) with clips or brackets 339 to the channel 330. Typically, the lens 338 and light strip of LEDs 332 have an equal length, $L_1$, or the lens 338 may be somewhat longer than the light strip on the board 334. To allow the first light source to be selectively oriented, the channel 330 is mounted at its ends to swivel 331 about its axis with the rotation 319 of orientation adjustment knob 318 on plate 316 (e.g., the knob 318 is rigidly attached to a support pin affixed to the channel 330 as shown in FIG. 5).

Likewise, a second light source is provided in the assembly 300 by mounting a channel 340 at its ends to the plates 314, 316 to be spaced apart from the central axis of plates 314, 316 (or rods 310, 315) such as opposite the other support or channel 330. As with the first source, the second light source includes a mounting or power board 342 in the channel 340 upon which a plurality of LEDs 344 are mounted in a line to form a light strip. A projection lens 348 is mounted above or over the LEDs 344 with clips 346 attached to the channel 340. The second light source may be the same length as the first light source or have a length, $L_2$, that is less so as to achieve a desired effect. The second light source may be positioned anywhere along the length of the channel 340. The two light sources are elongate and generally are mounted to be parallel (as are the lenses 338, 348 relative to the light strips formed by LEDs 332, 344). The second source pivots about its axis as shown at 341 by providing pivotal mounting at its ends with adjustment or orientation selection achieved by rotating 321 the knob 320 (which may be held in place with frictional fitting, with lock washers, or the like once a desired orientation is achieved).

Figure 4:
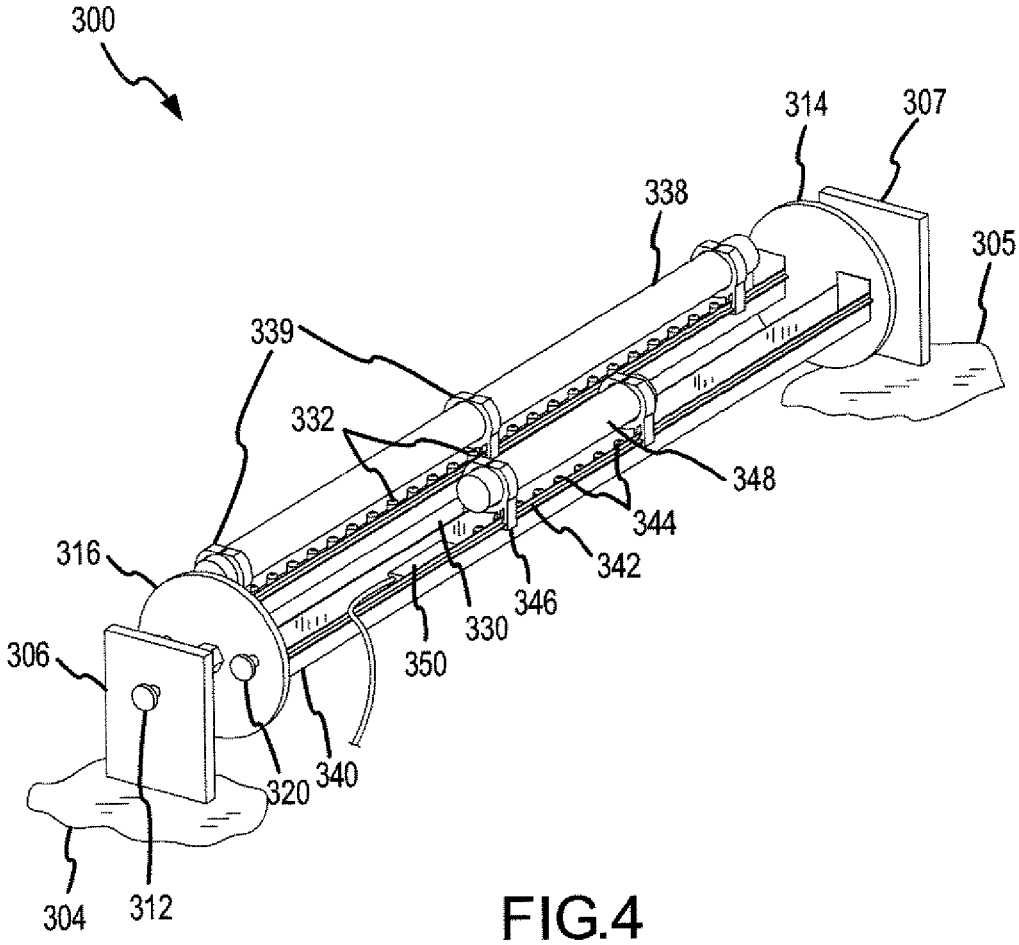
FIG. 4 illustrates a perspective view of the light sheet assembly of FIG. 3 with the light sources moved to a second position in which the sources are in a single horizontal plane.

During operation as shown in FIGS. 3 and 4, the position of the light sources may be selected or adjusted by rotating 313 knob 312 to rotate 311 the plates 314, 316, with FIG. 3 showing the lenses 338, 348 in differing planes (i.e., lens 338 being higher or closer to a display or the like) and FIG. 4 showing the lenses 338, 348 in the same horizontal plane, for example. Also, the orientation of the sources may be selected by rotating 331, 341 the channels 330, 340 with knobs 318, 320 such as to have both directed straight up (or perpendicular to a horizontal plane passing through the source), to have the larger first source straight up and the second smaller source oriented to have its output light sheet cross the output light sheet from first source. For example, the first source may include numerous amber LEDs 332 (e.g., 30 to 70 or more amber LEDs with a 100 degree viewing angle or beam spread) mounted in a PCB 334 and connected to an AC to DC converter or power supply (not shown) and arranged linearly with a length, $L_1$, of 2 to 3 feet or the like. The second source may include a smaller number of red LEDs 344 (e.g., 5 to 15 red LEDs with a 100 degree viewing angle or beam spread) mounted in a PCB 342 and powered by a power supply 350 that is connected to a power source (such as 120 VAC source). The LEDs 344 are arranged in a line or linearly with a length, $L_2$, (e.g., a few inches to 3 feet) less than the first length, $L_1$. Typically, the position of the second source is fixed but in some embodiments, the second source may be provided so as to be movable along the length of the channel 340 such as on a track or chain to allow a display to be created with varying mixing of the output light sheet from the second source with the light sheet from the first source.

Figure 5:
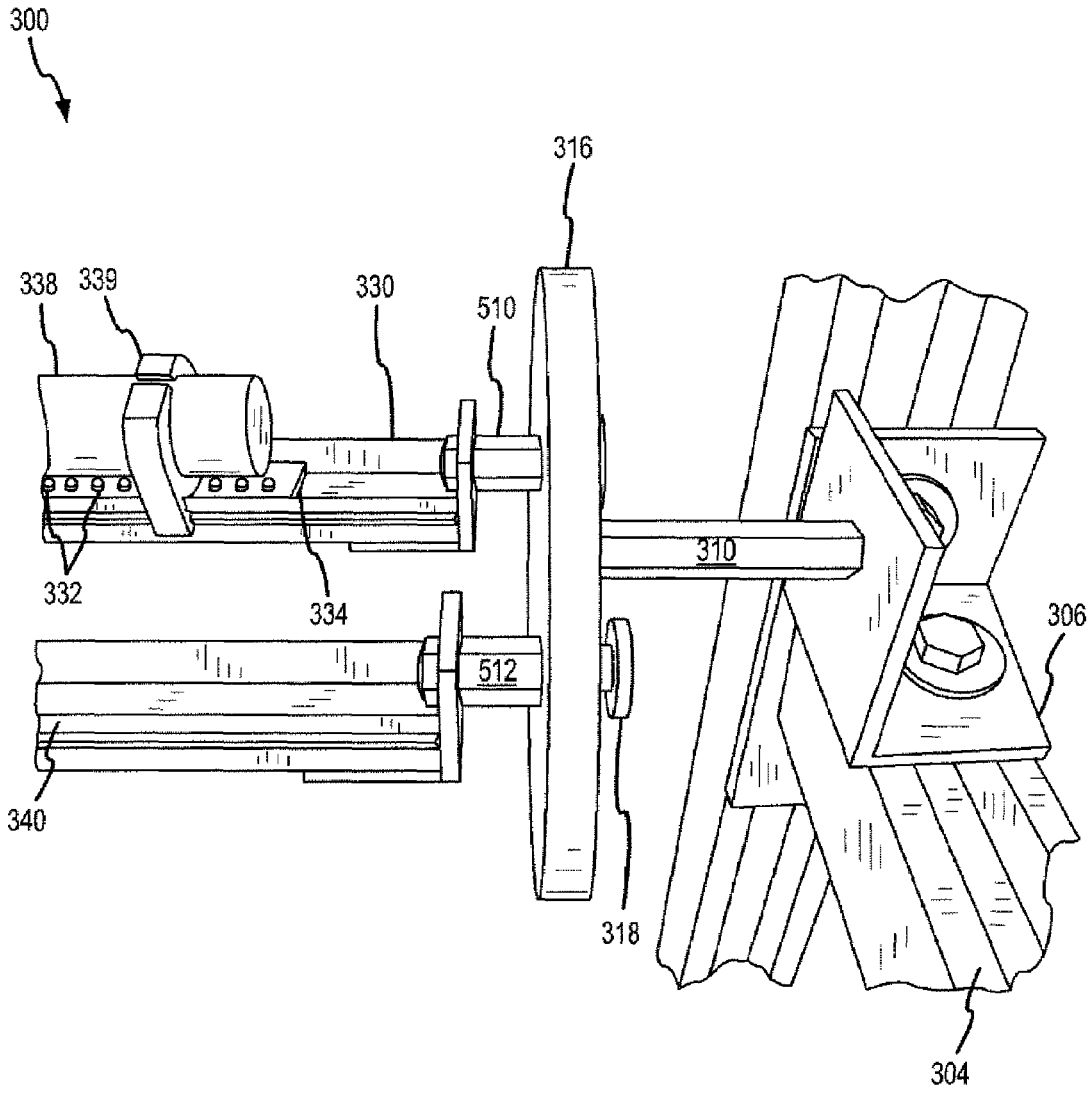
FIG. 5 is an enlarged side view of an end portion of the light sheet assembly of FIGS. 3 and 4 better illustrating the separate mounting of the two light sources for concurrent positioning and separate adjustment of their orientation.

FIG. 5 illustrates in more detail the end mounting of the assembly 300 that allows rotation of the plate 316 as well as pivoting of the channels 330, 340. As shown, a strut configuration 304 is provided to support the mounting element 306, which is fastened to the strut 304. The positioning rod 310 extends from the mounting element 306 to the plate 316 and is rigidly fixed to the plate (such as with a nut threaded onto the end of the rod 310 as shown). When the rod 310 is rotated about its support on the mounting element 306, the attached plate 316 also rotates so as to position the channels 330, 340 and light strips positioned therein and lenses attached to the channels 330, 340. The channels 330, 340 also may be oriented or have their orientation adjusted by turning knobs such as knob 318 that are attached to mounting or pivot pins 510, 512. The pivot pints 510, 512 are affixed (such as with a nut, welding, or the like) to the end of the channels 330, 340 and are free to pivot in a hole in the plate 316 (at least until an orientation that is desired is achieved and at this point the knob 318 may be tightened or other methods used to lock the orientation of the channel 330, 340 and associated light sources).

Figure 6:
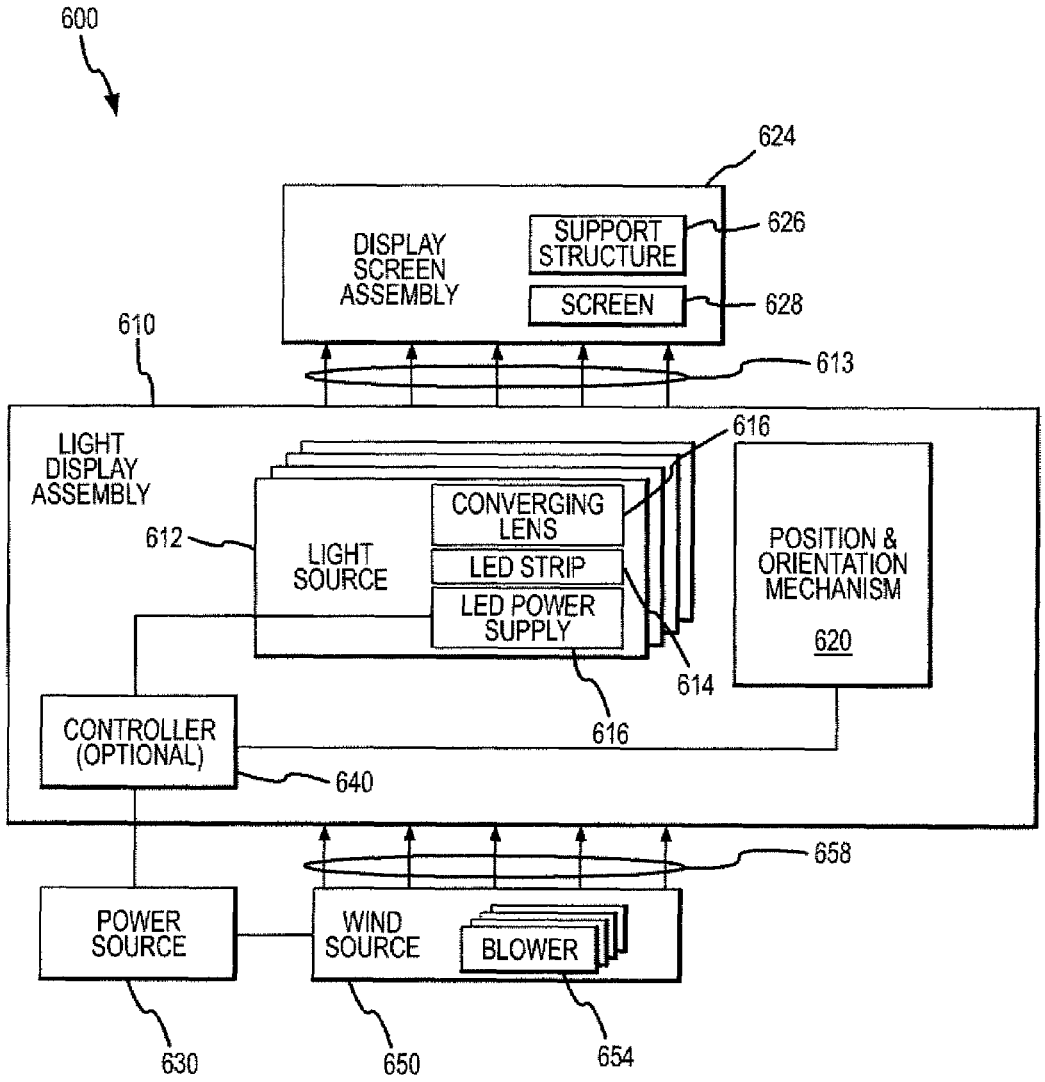
FIG. 6 is a functional block diagram of a flame simulator using a light display or light sheet assembly of the present invention that is useful for showing the use of two or more light sources, such as LED strips combined with one or more converging lenses, and a position and orientation mechanism (each of which may be manually adjusted or be controlled using software or in response to received control signals).

With these physical implementations of light sheet display assemblies understood, FIG. 6 illustrates in functional block form a special effect system 600 of the invention. As shown, the system 600 includes a light display assembly 610 that generates a thin sheet or curtain of light 613. The light sheet 613 is produced by the blending or combination of two or more light sources 612, which may be of differing color, differing length and/or thickness, and/or differing brightness or power (or these characteristics may be the same for one or more of the light sources 612). The light sources 612 may be configured as shown in FIGS. 1-5. As shown, the sources 612 each include an LED strip 614 that are combined with a projection lens 616 to produce the thin sheet of light 613. One or more LED power supplies 616 is included to provide the power required by the LED strips 614 (e.g., DC power) from a connection with power source 630 (e.g., an AC power source). The power supply 616 may be adjustable to control the amount of power provided to one or more of the LED strips 614 and such adjustment may be manual (e.g., the power supply 616 may include an adjustable or controllable light source driver for each light strip) or may be programmed via an optional controller 640 (e.g., which may include software and/or hardware to selectively operate the LED strips and/or to control their brightness such as to strobe one or more of the strips 614, to wash or fade one or more of the strips 614 up or down in brightness, or to achieve other effects).

The light display assembly 610 further includes a position and orientation mechanism 620 that is adapted for positioning the light sources 612 in the same horizontal (or vertical) plane or in differing planes or, in some embodiments, to alter the distance between the light sources (e.g., the sources 612 may be mounted in slots or tracks in end plates to allow their end mount positions to be altered such as increase or decrease the distance between two or more of the sources 612). The orientation of each (or at least some) of the light sources 612 is also adjustable by the mechanism 620 (such as by rotation about an axis of the sources 612). The controller 640 may be used to monitor and/or control operation of the mechanism 620, such as to automatically adjust the position and/or orientation of the light sources 612 based on a program and/or sensed events or received control signals.

A display screen assembly 624 is provided to use the light sheet 613 to create a specific illusion such as a large flame simulation. The assembly 624 includes a support structure 626 (such as a window frame, a wooden log or other structure, or the like) and a screen 628 that may be formed from a fabric sheet or curtain that is hung or otherwise supported by the structure 626. The screen 628 is typically animated to achieve a high quality effect, and wind 658 is directed over the screen 628 from a wind source 650 that is shown to include one or more blowers or fans 654 powered by power source 630.

In addition to tuning of LEDs to achieve a desired color result, flame simulators of the present invention may include an LED controller 640 that runs one or more flame simulation routines to alter the brightness of the two or more LEDs on a regular or random time schedule, which produces a varying brightness of the flames found in real fires. The realism of the fire may be even further improved by providing one or more LEDs or other light sources that are caused to flash or be turned on/off at regular or random intervals to illuminate flame elements so as to cause pops or sparks in the flame simulator as is typical of wood and other fuel source fires. With programming, the light sources can be caused to vary their brightness in a relatively slow and varying pattern while also having one or more flash sources that are turned on and off very quickly (such as in a fraction of a second) to produce a very effective flame illusion when compared with common devices that use a single, constant-brightness light source.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. Some embodiments of the light display assemblies of the invention are particularly useful for use in flame simulators and similar lighting special effects. However, those skilled in the art will readily understand that the assemblies may also be used in architectural lighting, themed lighting, and other effects or displays in which a sheet of light is used. Additionally, the assemblies shown are generally used for large displays or effects (such as a full size window that is in a burning building), but the concepts of the assemblies (e.g., a light strip such as a strip of LEDs combined with low cost but effective projection lensing) are easily scalable for use in smaller (and larger) display systems. Additionally, RGB and other colored LEDs or strip lights may be used to practice the invention. Further, the LEDs may be controlled, such as with software or hardware, to create varying outputs such as by washing the brightness of the LEDs up and down slowly, varying the colors, strobing or quick flashes of light, fading, and the like). Yet further, the light sources shown in the attached figures utilized a single projection lens but the light sources may also use two or more lenses in combination to focus the output of the light strips into a light sheet having desired thickness and converging/diverging characteristics.

We claim:

1. An apparatus for generating a sheet of light, comprising:

a first light strip positioned on a first support member;

a second light strip positioned on a second support member; and elongate first and second lenses extending substantially parallel to the first and second light strips, respectively, wherein light generated by the first and second light strips is focused by the first and second lenses into a sheet of light formed by mixing light generated by the first and second light strips.

2. The apparatus of claim 1, wherein the first and second lenses comprise elongate cylindrical rods that are mounted to the first and second support members, respectively, and spaced apart from the first and second light strips.

3. The apparatus of claim 2, wherein the cylindrical rods comprise a glass, plastic, and/or ceramic that is at least translucent to the light generated from the first and second light strips and have a diameter of at least about 0.5 inches.

4. The apparatus of claim 1, wherein the first and second light strips are spaced apart and are parallel to each other in a single plane.

5. The apparatus of claim 4, further comprising means for moving at least one of the first and second light strips such that the light strips are in differing planes.

6. The apparatus of claim 1, wherein the first and second support members are mounted to allow the support members to be swiveled about an axis extending parallel to the support members, whereby orientations of the first and second light strips can be adjusted.

7. The apparatus of claim 1, wherein the first and second light strips each comprise a set of light emitting diodes (LEDs).

8. The apparatus of claim 1, wherein the set of LEDs in the first light strip differ in color from the set of LEDs in the second light strip.

9. The apparatus of claim 1, wherein the second light strip has a length that differs from a length of the first light strip.

10. The apparatus of claim 1, wherein the first and second light strips each have a beam spread of greater than about 20 degrees and the first and second lenses each are configured to converge the beam spread of the first and second light strips to a spread of less than about 20 degrees.

11. A flame simulator, comprising a fan moving a volume of air;

a display screen positioned in the moving air; and a light sheet display assembly comprising a linear strip of light emitting diodes each generating a beam of light and a lens bending the beams of light into a sheet of light directed toward the display screen.

12. The flame simulator of claim 11, wherein the lens comprises an elongate cylindrical lens spaced apart from the linear strip and extending substantially parallel to the linear strip.

13. The flame simulator of claim 11, further comprising an additional linear strip of light emitting diodes having a color differing from the linear strip and an additional lens bending beams of light from the additional linear strip into an additional sheet of light directed toward the display screen.

14. The flame simulator of claim 13, wherein the linear strips are supported on spaced apart supports that are each mounted at distal ends to a pair of mounting plates, wherein the mounting plates can be rotated to concurrently set positions of each of the linear strips, and wherein the supports are mounted for independent rotation to independently define an orientation of each of the linear strips.

15. The flame simulator of claim 13, further comprising a controller for selectively operating at least one of the linear strips including varying a brightness level of the light emitting diodes.

16. The flame simulator of claim 11, wherein the sheet of light has a spread of less than about 20 degrees.

17. A light sheet display assembly, comprising:

a pair of spaced apart mounting plates;

a pair of elongate supports extending between and supported by the mounting plates;

a light strip attached to each of the supports generating dispersed beams of light; and a cylindrical lens positioned adjacent to each of the light strips, wherein the cylindrical lens focus the dispersed beams of light from each of the light strips into a thinner sheet of light.

18. The assembly of claim 17, wherein the light strips each comprises a plurality of light emitting diodes and wherein the beams of light from a first one of the light strips have a first color and the beams of light from a second one of the light strips having a second color that differs from the first color.

19. The apparatus of claim 17, wherein the mounting plates are rotatable to place the supports within a single plane or in differing planes.

20. The apparatus of claim 17, wherein the lenses are each rigidly attached to one of the supports and wherein the supports are supported by the mounting plates to allow the supports to be rotated about an axis extending parallel to each of the supports, whereby an orientation of the light strips can be selected to control a direction of the sheets of light output from the lenses.

* * * * *